US007832597B2

(12) United States Patent
Scheindel

(10) Patent No.: US 7,832,597 B2
(45) Date of Patent: Nov. 16, 2010

(54) VALVE FOR A PRESSURIZED PRODUCT DISPENSING CONTAINER

(76) Inventor: Christian T. Scheindel, 2065 Ridge Rd., Randolph Center, VT (US) 05061

( * ) Notice: Subject to any disclaimer, the term of this patent is extended or adjusted under 35 U.S.C. 154(b) by 506 days.

(21) Appl. No.: 11/842,640

(22) Filed: Aug. 21, 2007

(65) Prior Publication Data

US 2008/0041888 A1 Feb. 21, 2008

Related U.S. Application Data

(63) Continuation-in-part of application No. 11/334,716, filed on Jan. 18, 2006, now abandoned, which is a continuation-in-part of application No. 10/882,625, filed on Jun. 30, 2004, now abandoned, which is a continuation of application No. 10/816,969, filed on Apr. 2, 2004, now abandoned, which is a continuation of application No. 10/285,238, filed on Oct. 31, 2002, now abandoned.

(51) Int. Cl.
*B65D 83/00* (2006.01)

(52) U.S. Cl. ..... 222/402.22; 222/402.1; 222/402.24; 222/399

(58) Field of Classification Search ..... 222/402.1, 222/402.15, 402.24, 402.25, 399, 402.23, 222/402.22
See application file for complete search history.

(56) References Cited

U.S. PATENT DOCUMENTS 2,808,806 A 10/1957 Tysinger
2,914,224 A 11/1959 Michel
2,957,610 A 10/1960 Michel
2,965,270 A 12/1960 Soffer et al.
2,994,461 A * 8/1961 Michel ..... 222/153.11
3,089,625 A 5/1963 Sorber
3,206,082 A * 9/1965 Green ..... 222/402.17
3,415,426 A 12/1968 Klevland
4,165,825 A 8/1979 Hansen
4,522,318 A 6/1985 Del Bon
4,752,020 A 6/1988 Grueter et al.
4,791,723 A 12/1988 Jacobson
4,805,813 A 2/1989 Metcoff et al.
5,040,705 A 8/1991 Snell (Continued)

*Primary Examiner*—Kevin P Shaver
*Assistant Examiner*—Melvin A Cartagena
(74) *Attorney, Agent, or Firm*—Cowan, Liebowitz & Latman

(57) ABSTRACT

An axially actuated valve primarily for use in a pressurized container having a dip tube comprises a vertical moveable valve element having a stem, button on the base of the stem and sidewall openings at the lower part of the stem. A resilient annular sealing grommet has a recess in its base into which the button fits. When the valve is closed, the button engages the ceiling of the recess to block product from reaching the sidewall openings. The button is within the recess at all times between its closed and open states. The button has upper and lower disc portions. The lower disc portion optionally has a tubular tail to engage a dip tube. The upper disc portion has edge recesses that provide communication between the stem wall openings and a zone created when the valve element is depressed. The button has a vertical passageway through the lower disc portion and a horizontal passageway between the two disc portions extending out to the edge recesses in the upper disc portion. When the valve is open, a passage is provided to dispense product through the passageways within the button to communicate with the stem sidewall openings.

19 Claims, 7 Drawing Sheets

U.S. PATENT DOCUMENTS

| | | | | |
|---|---|---|---|---|
| 5,070,611 | A | 12/1991 | Derin et al. | |
| 5,450,983 | A | 9/1995 | Stern et al. | |
| 5,785,301 | A | 7/1998 | Scheindel | |
| 5,787,301 | A | 7/1998 | Arakawa et al. | |
| 6,321,951 | B1 | 11/2001 | Frutin | |
| 6,340,103 | B1 | 1/2002 | Scheindel et al. | |
| 6,425,503 | B1 | 7/2002 | Scheindel | |
| 6,474,510 | B2 | 11/2002 | Frutin | |
| 6,685,064 | B2 | 2/2004 | Frutin | |
| 6,820,777 | B2 | 11/2004 | Frutin | |
| 6,918,516 | B2 | 7/2005 | Frutin | |
| 7,364,055 | B2 * | 4/2008 | Yquel et al. | 222/402.21 |
| 2004/0256418 | A1 | 12/2004 | Scheindel | |

* cited by examiner

ALL DIMENSIONS ARE IN INCHES

VALVE FOR A PRESSURIZED PRODUCT DISPENSING CONTAINER

REFERENCE TO RELATED APPLICATIONS

This application is a continuation-in-part of Ser. No. 11/334,716 filed Jan. 18, 2006 now abandoned, which in turn is a continuation-in-part of Ser. No. 10/882,625 filed Jun. 30, 2004 now abandoned, which in turn is a continuation of Ser. No. 10/816,969 filed Apr. 2, 2004, now abandoned, which in turn is a continuation of Ser. No. 10/285,238 filed Oct. 31, 2002, now abandoned; the entire disclosures of which are hereby incorporated by reference.

BACKGROUND OF THE INVENTION

This invention relates in general to valves for pressurized dispensing containers and more particularly to a valve whose design makes it particularly useful for containers in which a dip tube is employed. The dip tube provides a passageway between the pressurized product to be dispensed and the dispensing valve.

Applicant's U.S. Pat. No. 5,785,301 and No. 6,425,503 and No. 6,340,103 are representative of prior art valve designs for use in hand held pressurized containers.

Pressurized containers for dispensing product can be categorized into a first type that employs a barrier between the product and the pressurized gas and another type in which the pressurized gas and the product are mixed. The latter type typically employs a dip tube that extends from the dispensing valve to the bottom of the container in which the product and pressurized gas is mixed. This dip tube arrangement is normally employed where product being dispensed is a mist or a spray. However, a dip tube can also be used where the product being dispensed is a highly flowable product such as a shave gel.

The valve assemblies employed in these dip tube type of designs normally have five components. These five components are a mounting cup, a movable valve element that moves between an open and closed position, a first resilient sealing element to seal the valve to the dip tube, a second resilient sealing element to seal the valve stem openings when in the closed state and a spring to return the valve to its closed state once finger or hand pressure is removed from the actuator.

Maintaining the cost of these valve assemblies at a minimum its an important factor in keeping the cost of the end product reasonable and accessible to the public.

Part of the cost of these valve assemblies is in the number of components that constitute the valve assembly (five components in the typical known art) and part of the cost is in the difficulty or ease in assembling the various components that make up the valve assembly.

Accordingly, it is a major purpose of this invention to provide a valve assembly which is less expensive by reducing the number of components and reducing the cost to assemble.

It is another purpose of this invention to provide a dispensing valve that can be optimally adapted for use with a container in which a dip tube is used.

A further purpose of this invention is to provide a valve adapted to be used in a vertical fashion; that is, used by axial movement of the valve element.

BRIEF DESCRIPTION

The valve assembly disclosed has three components, a mounting cup, a movable valve element having a stem and a button and a sealing grommet having a recess into which the button of the stem fits. The button and grommet engage under pressure along the ceiling of the recess to seal the product in the closed or sealed state. The button has an upper segment with a smaller diameter and a lower segment with a greater diameter. The lower segment of the button has an interference fit relationship with the sidewall of the recess to prevent significant migration of product or propellant around the periphery of this lower portion of the button when the valve is in an open state.

The preferred button disclosed has a tail which engages a dip tube. The button has a passageway in the tail and through the main portion of the button. The upper segment of the button has recesses to provide communication for product being dispensed through the passageway within the button to the recesses and then into a zone above the button; which zone is created when the button is depressed in the open state of the valve. This zone above the button is in communication with the valve openings in the stem of the valve. This permits product, in the open state of the valve, to flow up through the valve stem and out the actuator at the upper end of the valve stem.

The passageway through the button extends up through the lower segment of the button and transversely within the button to the recesses in the button upper segment edge.

The grommet contains an upper boot portion for restoring the valve to its closed state when pressure is removed from the valve. The boot portion is an annular relatively thin upward extension of the main portion of the grommet. The boot terminates in an edge that engages a shoulder in the valve stem thereby providing upward pressure on the valve stem when the valve element is depressed against the upper edge of this boot.

It is important that the top of the boot have an inwardly directed annular flange that snugly engages an annular recess or groove in the valve stem. This assures that the boot does not escape the shoulder under the restoring pressure exerted when the boot is fully collapsed.

This arrangement of functions so that only three parts constitute the valve assembly requires that the button is specifically designed to have a horizontal component of the passageway through the button directed to the edges of the upper segment of the button and thus divert the product being dispensed into the zone created above the button when the valve stem is depressed during the open state of the valve.

The grommet has an annular bore that engages the valve stem. The lower part of the bore has an interference fit relation with the valve stem from the button to at least the top of the valve stem openings. This interference engagement enables user control over the rate at which product is dispensed. When the user partially depresses the valve element and thus exposes only a portion of the stem openings to the product, the rate at which product is dispensed is controlled.

In a preferred embodiment, the valve stem openings are elongate in the axial direction and have tapered edges. This design further enhances user control over the rate at which product is dispensed when the valve element is used in a vertical direction.

Terminology

As used herein, the term "upper" and formatives thereof should be understood to refer to a location closer to the dispensing actuator; that is, the element which is usually actuated with the finger of the user. The terms "lower" and "down" and formatives thereof should be understood to refer to a location closer to the interior of the container on which the valve assembly is mounted. Most containers are stored on their base. The input end of the valve is lower in the container and the output end is at the upper end. Many products are dispensed upside down or laterally. It should be understood herein that the terms "upper" and "lower" are used to indicate relative position or direction in connection with the above convention; and are not used with respect to the container when dispensing product.

The term "valve" is sometimes used in a more inclusive sense and other times in a less inclusive sense. As used herein, the term "valve assembly" will normally be used to refer to the three element combination of the mounting cup, a movable valve element and a sealing grommet. The term "valve" will usually be used to refer to the combination of the movable valve element and the sealing grommet. And, to provide an appropriate distinction, the term "valve element" will be used to refer to the element around which the grommet is mounted and which is depressed in a downward direction relative to the grommet to provide an open state and when released move up relative to the grommet to provide a closed state.

The grommet has as its main function to seal the valve stem openings by sealing contact between the upper surface of the button and the ceiling of the recess in the grommet. Thus, it is referred to herein as a sealing grommet. The upper portion of the grommet is referred to as a boot. The boot portion engages a shoulder on the valve stem. The boot is resilient and compresses when the valve is opened. The boot serves to provide a restoring force on the valve element to close the valve when finger pressure on the actuator is released.

There is a "full engagement" relationship between the flange 54 at the top of the boot 50 and the recess 56 in the valve stem 22. In the embodiment disclosed, a 20 mil thick resilient material flange engages a 20 mil thick non-resilient recess. This engagement is referred to herein as a "full engagement" or as "two elements being fully engaged". This engagement will normally be tighter than that which is called a slip fit relationship and thus is also referred to as a "snug" relation. Nominally the two dimensions being engaged are equal. There may be some slight variation depending upon the requirements of assembly and the materials used. The purpose is to provide as snug a fit as possible in order to avoid having the boot 50 slip out of engagement and move over the shoulder 48 when the valve is fully depressed.

The open state of the valve is normally used to refer to both fully open and partially open valve conditions.

A mil is a thousandth of an inch (0.001 inches).

BRIEF DESCRIPTION OF THE DRAWINGS

FIG. 2 shows the valve in its closed state.

DESCRIPTION OF THE PREFERRED EMBODIMENTS

Figure 7:
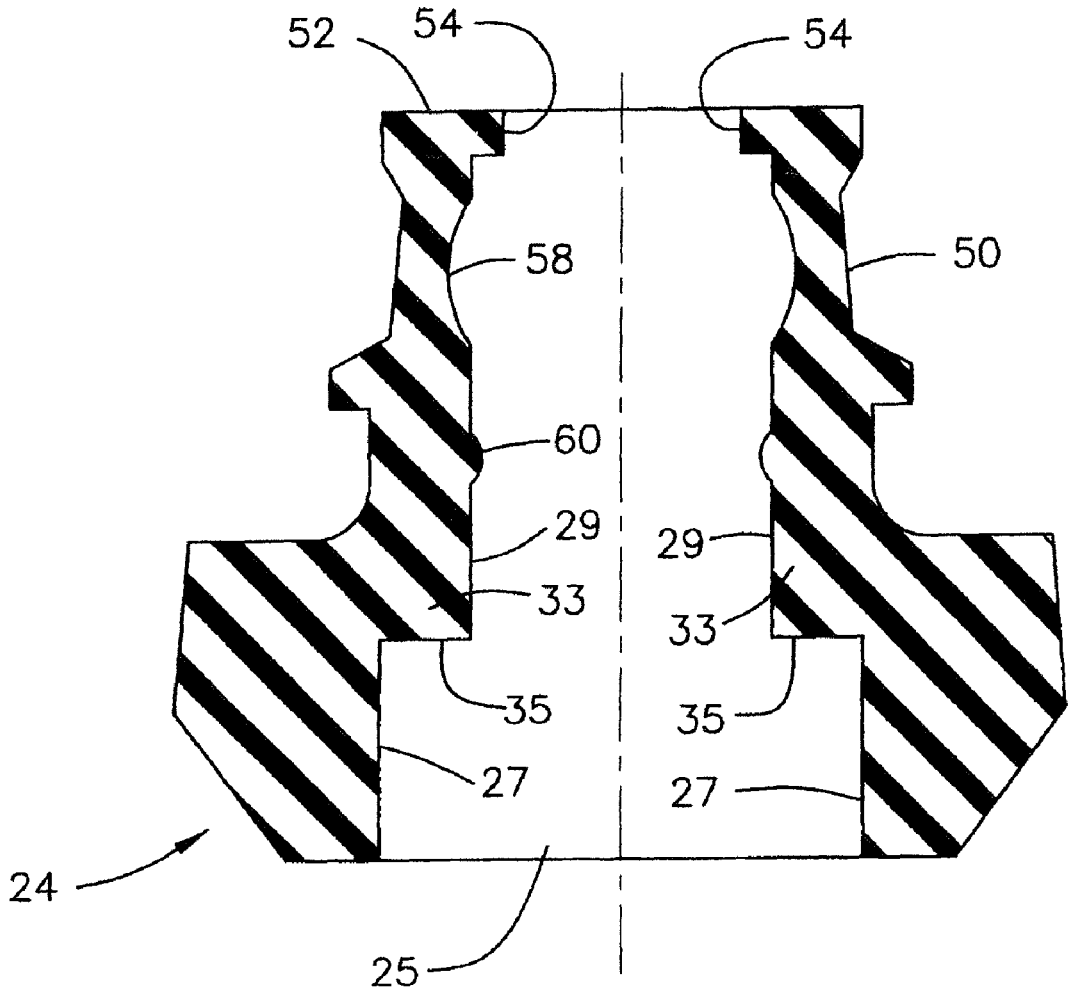
FIG. 7 is a sectional view through the grommet in its relaxed state.

The FIGS. represent a single embodiment. The valve assembly 10 is shown mounted on a container 12 that does not have a barrier between the product 14 to be dispensed and the gas 16 which provides the pressure. A spray actuator 18 is shown mounted on the top of the valve assembly 10. The valve assembly 10 is composed of three elements; namely, a mounting cup 20, a vertically movable tubular valve element 22 and a grommet 24 which surrounds the center section of the valve element 22. The grommet 24 has a recess 25 in its base (see FIG. 7). The valve element 22 has a button 26 at its lower end (see FIG. 4). The button 26 fits into the recess 25. There is an interference fit relation between the lower segment 38 of the button 26 and the sidewall 27 of the recess 25. The recess 25 is deep enough so that the button 26 stays within the recess 25 even when depressed into the fully open state. A tail 28 of the button engages a dip tube 31 which extends down from the valve element 22 to the bottom of the container 12.

The valve element 22 has a stem 32 with a center passageway 34. The button 26 is at the base of the stem 32. The tail piece 26 which holds the dip tube 31 extends below the button 26. Sidewall openings 36 near the base of the stem 26 are sealed by the grommet 24 when the valve is in its closed state. In that closed state, the valve element 22 is in its uppermost position. The valve stem sidewall openings 36 are in communication with the product being dispensed when the valve is in an open state. When the valve element 22 is depressed, the openings 36 are exposed to a zone 46 around the top of the button 26 which zone 46 in turn is in communication with the product to be dispensed through passageways in the dip tube 31, the tailpiece 28 and the button 26.

A dip tube 31 is typically used in a design where the product and propellant are mixed together under pressure within the container 12. When propellant is a liquid, usually hydrocarbon, the pressure tends to remain the same because the liquid hydrocarbon evaporates. However, if the propellant is a gas such as nitrogen under pressure, then there will be a loss of pressure as product is dispensed. In addition, there is a design in which a foreshortened dip tube (not shown) is used that extends into a bag containing product. In that case, the propellant under pressure is outside of the bag and the bag is a barrier between propellant and product.

In all cases, one of the advantages of the design shown is that it provides the user with an ability to control the rate at which product is dispensed. This user dispensing control function can be used in the appropriate situation to compensate for the lower pressure that occurs as product is dispensed. The dispensing control function can also be employed to permit the user to control the rate at which product is sprayed and therefore affect the spray pattern. This latter situation is most likely in a context where the propellant is a liquid mixed in with the product.

The portion 29 of the grommet 24 that engages the lower portion of the stem 32, does so with an interference fit relationship. For example, in a typical mist applicator embodiment, a stem wall outer diameter of 152 mils may be engaged by a grommet which in its relaxed state has an inner diameter of 142 mils.

This interference fit relationship extends from the button 26 up through at least the top of the stem wall openings 36. When the user pushes down part of the way on the valve 22, only a portion of the openings 36 are exposed to product. This assures an ability for the consumer to control the rate at which product is dispensed and, in particular, to compensate for the fact that the pressure is greater when product is first dispensed and lesser when most of the product has been dispensed. The interference fit, at the stem zone where the openings 36 are located, assures that this partial opening will be effective. The interference fit prevents the product under pressure from forcing the grommet away from the portion of the openings 36 covered by the grommet.

The corner 33 of the grommet 24 is orthogonal in relation to the horizontal sealing surface 35 of the grommet. This assures that the grommet surface 38 will be flush against the entire lower portion of the valve stem 32.

Figure 6:
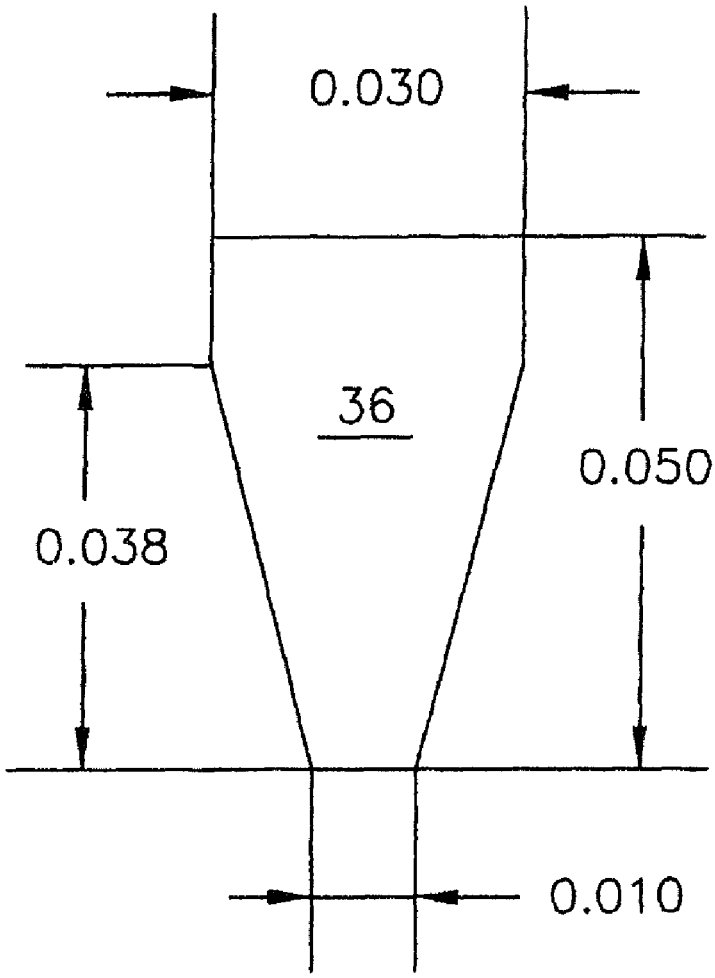
FIG. 6 is a larger scale view of the stem wall opening showing dimensions in one embodiment.

There are two stem wall sidewall openings 36. Each opening 36 is elongated in an axial direction and has tapered edges so that the width of the opening goes from a minimum at the lower point of the opening to a maximum near the top of the opening. An upper segment of the opening 36 is not tapered in one preferred embodiment. The dimensions of a typical opening in one embodiment are shown in FIG. 6. This variable width opening is of additional value to provide the user easy control over the rate at which product is dispensed.

The design of the button 26 is particularly important to provide the three piece valve assembly. The button 26 has an upper disc segment 37 and a lower disc segment 38. The lower disc segment 38 has an interference fit relation with the sidewall 27 of the grommet recess 25 to prevent product from migrating around the button 26. Recesses 40 are provided at the edges of the upper disc segment 37. The passageway within the button 26 has a first vertical portion 42 and a second horizontal portion 44. The horizontal portion 44 extends along the base of the upper disc segment 37 to the edge recesses 40 to complete communication from below the button, through the button to the recesses 40. When the valve opens and the button 26 moves down away from the ceiling of the grommet recess 25, an annular zone 46 is created which allows communication between the outlet of the horizontal passage 44 and the valve stem openings 36.

Figure 1:
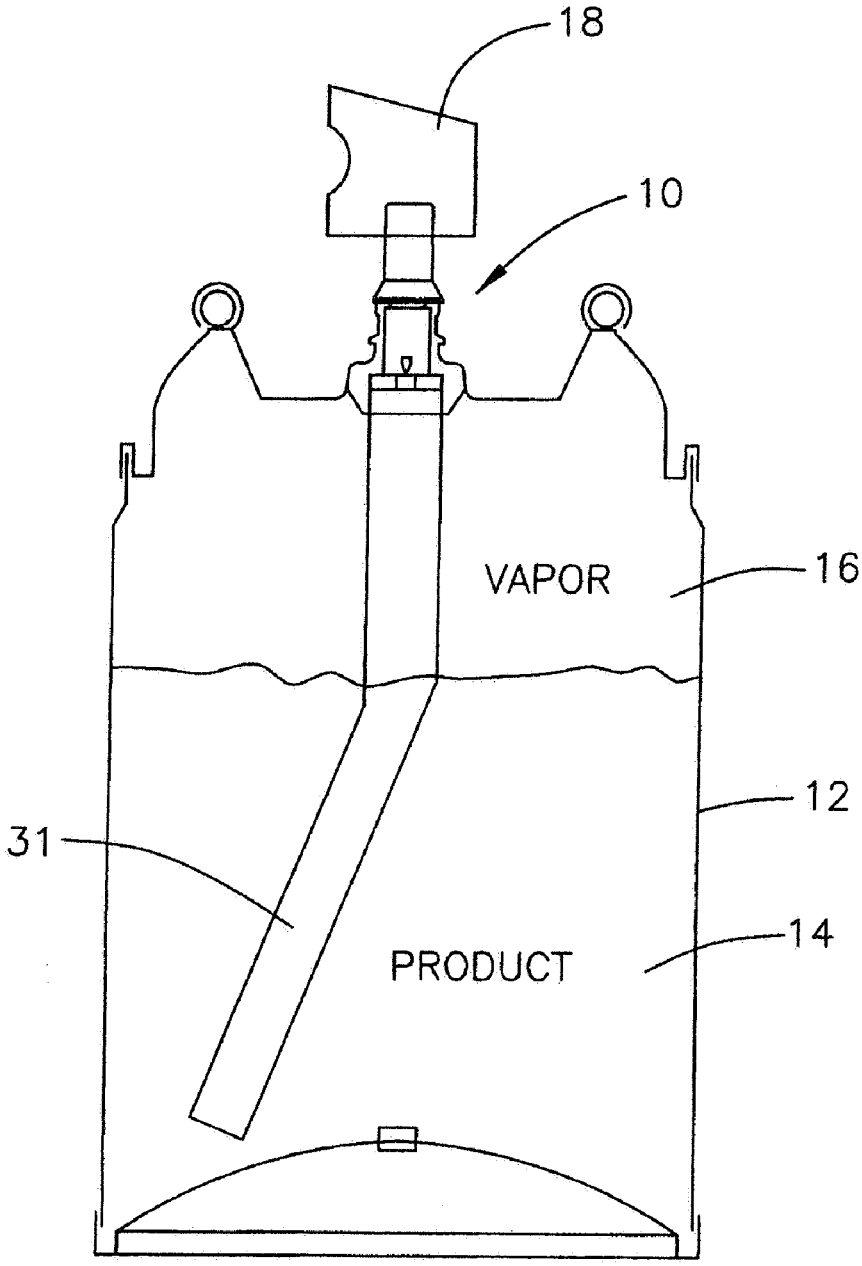
FIG. 1 is a schematic view showing a valve of this invention mounted in a pressurized container employing a dip tube 31. There is no barrier between the propellant and the product or liquid to be dispensed.
Figure 2:
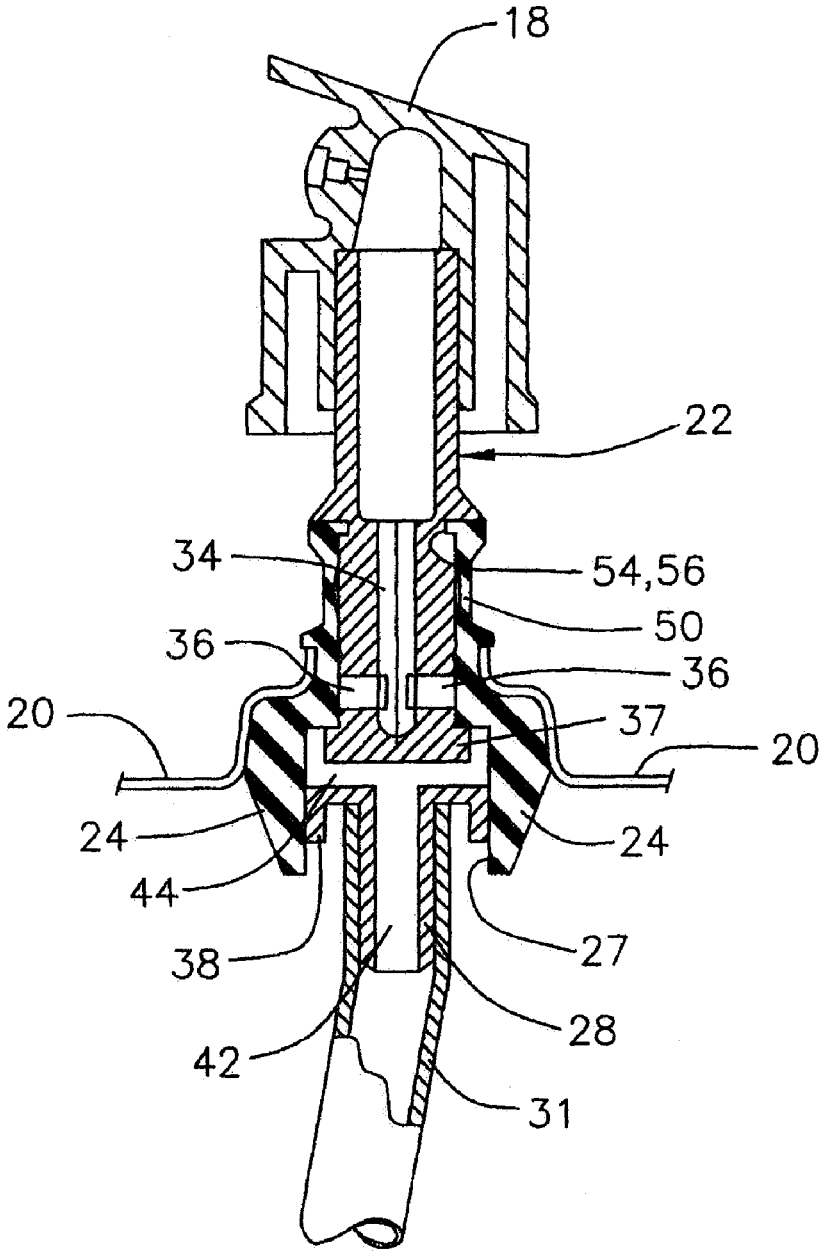
FIG. 2 is a larger scale view in longitudinal section showing the FIG. 1 valve attached to a dip tube and carrying an actuator 18 at its top.
Figure 3:
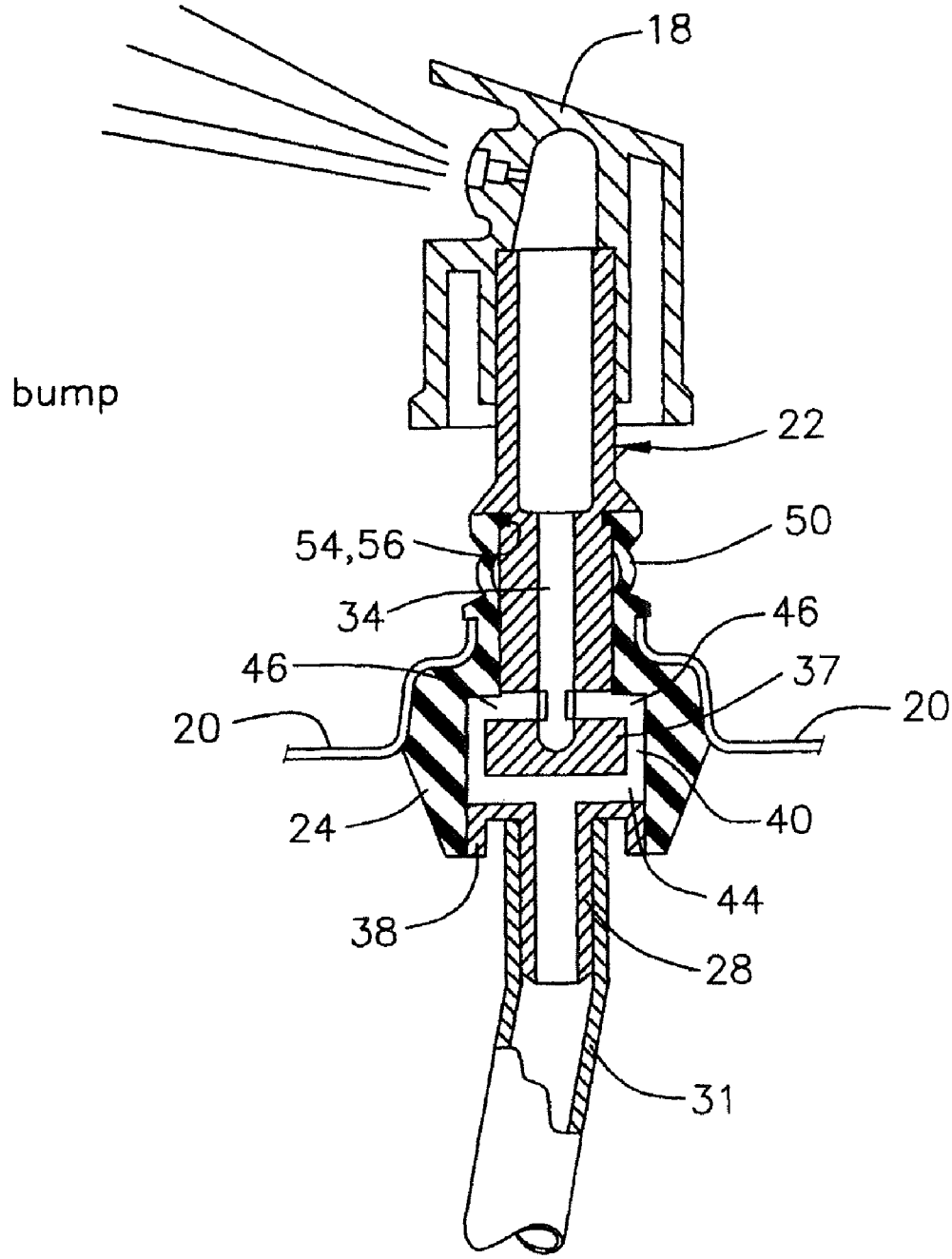
FIG. 3 is a view similar to that of FIG. 2 showing the valve in its fully open state.
Figure 4:
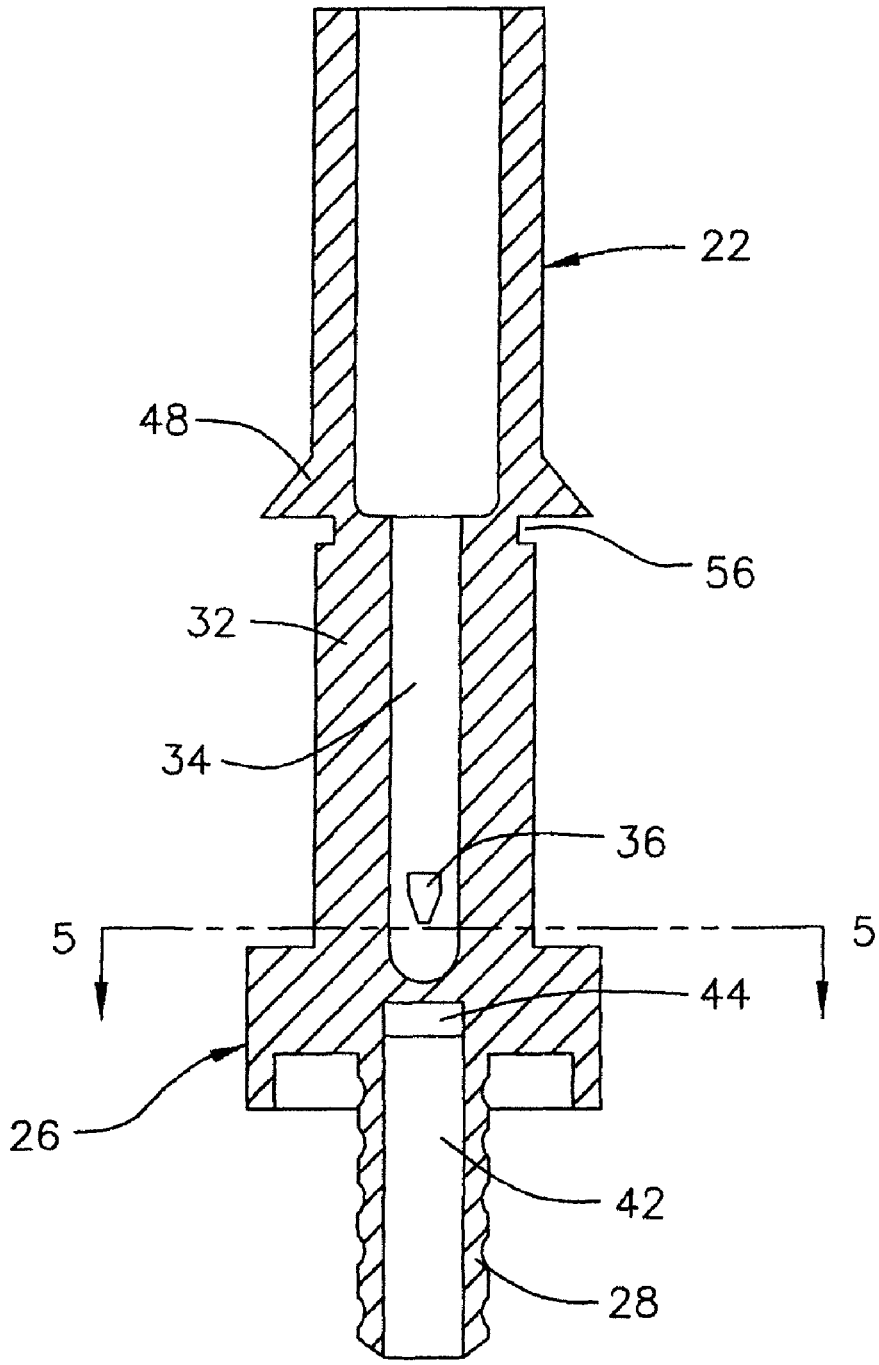
FIG. 4 is a view from the left of FIG. 2 providing an orthogonal view that more clearly illustrates the side wall openings 36.
Figure 5:
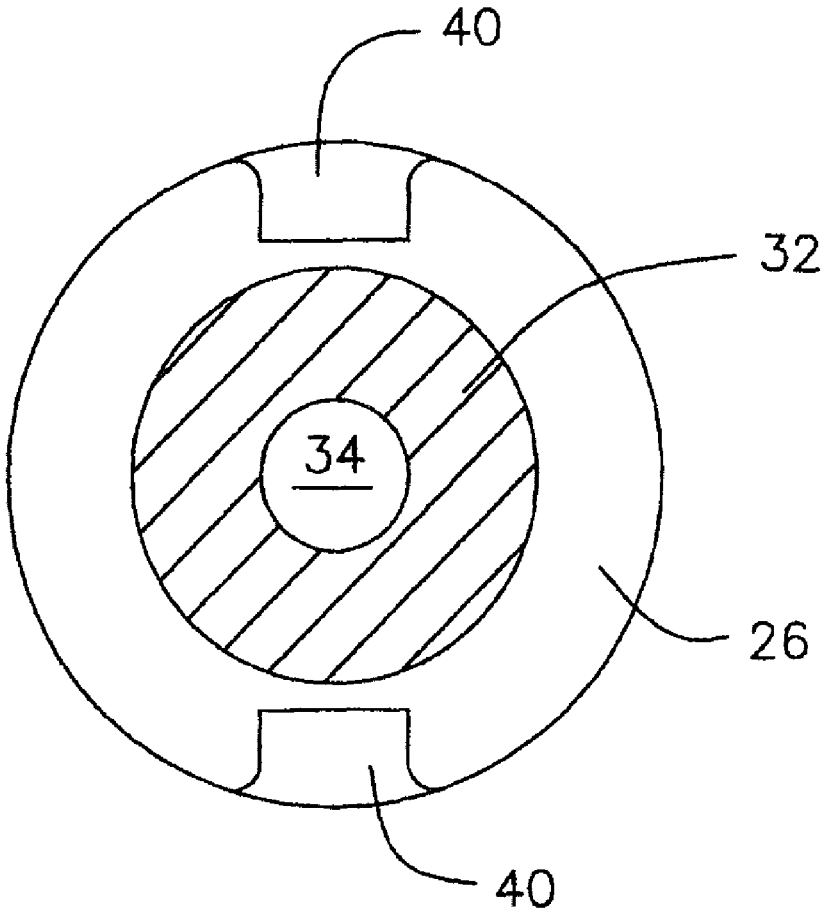
FIG. 5 is a view along the plane 5-5 of FIG. 4 looking down along the upper face of the button 26 and illustrates the recesses 40 in an upper disc portion of the button 26.

The horizontal passage 44 is preferably rectangular in order to provide a large enough passageway to avoid serving to constrict the valve openings 36. FIG. 4 illustrates an inner end view of one half of the horizontal passageway 44. In general, all product passageway cross sectional areas should be at least equal to the cross section area of the valve openings 36. FIG. 4 illustrates an inner end view of one half of the horizontal passageway 44.

Thus in the dip tube embodiment, opening the valve by pressing down on the actuator 18 creates a path for product from the product chamber, through the dip tube 31 and tail piece 28, through the vertical passage 42 in the button, through the horizontal passages 44 in the button, to the edge recesses 40, into the annular zone 46 and then through the valve stem openings 36, up the valve stem passageway 34 to be dispensed at the actuator 18.

This resilient sealing grommet 24 has an upper boot portion 50. The upper surface 52 of the boot 50 engages a shoulder 48 on the valve stem 32 to provide an upward force to assure that the valve element 22 returns to a closed state when pressure is removed from the actuator 18 attached to the valve. An inwardly extending annular flange 54 at the top of the boot 50 engages an annular recess 56 in the valve stem 32. This is a snug engagement so as to assure that the grommet 24 will remain properly positioned relative to the valve element 22 during the opening of the valve. This snug engagement 54, 56 together with the increased diameter of the shoulder 48, assures that when the valve element 22 is depressed, the boot 50 will not move up on the valve stem 32 and thus assures that the boot 50 will be appropriately compressed so that the force required for returning the valve 12, 24 to its closed position will be available.

The boot 50 has a concave inner surface 58 which assures that the boot 50 will buckle out when vertical pressure is applied when the valve element 22 is moved downward and thus avoid having the boot significantly resist opening of the valve. A vertical slit (not shown) in the boot 50 might be useful to ease actuation. That will depend on grommet material and boot size. The outer surface of the boot wall is radially recessed from the top outer edge of the boot so that the boot wall will resist opening only enough to assure that the boot wall on compression will provide the force needed to close the valve when operator pressure is removed.

An annular bump 60 on the bore of the grommet 24 can be of value to prevent product from leaking up between the valve stem and grommet when the valve is in its fully or partially open state.

The stem bore 34 extends below the openings 36 to reduce the amount of plastic used in molding and to facilitate cooling after molding.

Dimensions

In one example of the embodiment disclosed, a product useful for dispensing a mist or spray has the following dimensions. The FIGS. are not proportional to the following dimensions in order to provide a clearer presentation of the important features.

Grommet Recess 25: 251 mils in diameter and 215 mils deep.

Button 26: 150 mils thick; 100 mils for the upper disc segment 37 and 50 mils for the lower disc segment 38. Upper disc 37 is 250 mils in diameter and lower disc 38 is 253 mils in diameter.

Button horizontal passageway 44 within the upper disk 37 is 50 mils by 60 mils and vertical passageway 42 within the lower disc 38 is 70 mils in diameter.

Valve Stem 32: 152 mils outer diameter.

Grommet 24 inner diameter at the lower portion: 142 mils in relaxed state; engaging the 152 mil valve stem 32.

Center passageway 34 at location of the valve openings in valve stem 30: 70 mils (this passageway is slightly tapered in order to permit removal from the mold) and thus does not have a completely uniform diameter).

Shoulder 48 Diameter: 230 mils.

Valve Stem Openings 28: Dimensions are shown in FIG. 6. Total opening about 3850 square mils.

Boot flange 54: 20 mils thick by 20 mils long.

Stem recess 56: 20 mils thick by 20 mils deep.

While the foregoing description and drawings represent a presently preferred embodiment of the invention, it should be understood that those skilled in the art will be able to make changes and modifications to those embodiments without departing from the teachings of the invention and the scope of the claims.

For example, the preferred embodiment disclosed is for use with a dip tube. However this three piece valve assembly design could be used to dispense product without the tail 32 and without the dip tube 31.

The recesses 40 and passages 42 and 44 through the button 26 are designed as disclosed as they are easiest to implement and mold. However it is possible to design alternate passageway geometry.

What is claimed is:

1. A valve having a closed state and an open state for use with a pressurized dispensing container for dispensing spray products and low viscous products from a container comprising:

a vertically movable valve element having a stem with an axis, at least one side wall opening at a lower portion of said stem, and a button at the lower end of said stem, and a resilient annular sealing grommet having a bore around said stem, a recess in the base of said grommet to accept said but ton of said stem, said recess of said grommet being deep enough so that said button is within said recess when the valve is in its fully open state, said recess having a side wall, said button having upper and lower disc segments, said upper disc segment having an edge, a recess in said upper disc edge to provide communication between said edge recess and said valve stem sidewall opening when said valve is opened, said lower disc segment having an interference fit relation with said sidewall of said recess and having a diameter greater than the diameter of said upper disc segment, a passageway through said button to provide communication between product to be dispensed and said zone of said edge recess, a first portion of said passageway extending upwardly through said lower disc segment, a second portion of said passageway in communication between said first portion and said edge recess, said first portion of said passageway having a lower end adapted to be fitted to a dip tube.

2. The valve of claim 1 wherein: said bore of said grommet has an interference fit relation with the lower portion of said stem down to said button.

3. The valve of claim 2 wherein: said first portion of said passageway in said button is vertical and said second portion of said passageway in said button is horizontal.

4. The valve of claim 3 wherein: said second portion of said passageway is rectangular in cross-section.

5. The valve of claim 4 further comprising:

a boot portion of said grommet extending upward, said boot having an upper surface at an upper end, a shoulder extending radially outward from said valve stem, said upper surface of said boot engaging said shoulder to provide a force tending to restore said valve to its closed state, said boot having a radially inward flange at its upper end, said valve element stem having a recess adjacent said flange, said flange of said boot and said recess of said stem engaging to provide a snug fit.

6. The valve of claim 5 wherein;

said at least one valve stem sidewall opening has an elongate shape, elongate in the direction of said axis of said stem, said sidewall opening being at least partially tapered to provide a transverse distance greater at the upper portion of the opening and lesser at the lower portion of the opening.

7. The valve of claim 4 wherein:

said at least one valve stem sidewall opening has an elongate shape, elongate in the direction of said axis of said stem, said sidewall opening being at least partially tapered to provide a transverse distance greater at the upper portion of the opening and lesser at the lower portion of the opening.

8. The valve of claim 3 further comprising:

a boot portion of said grommet extending upward, said boot having an upper surface at an upper end, a shoulder extending radially outward from said valve stem, said upper surface of said boot engaging said shoulder to provide a force tending to restore said valve to its closed state, said boot having a radially inward flange at its upper end, said valve element stem having a recess adjacent said flange, said flange of said boot and said recess of said stem engaging to provide a snug fit.

9. The valve of claim 2 further comprising:

a boot portion of said grommet extending upward, said boot having an upper surface at an upper end, a shoulder extending radially outward from said valve stem, said upper surface of said boot engaging said shoulder to provide a force tending to restore said valve to its closed state, said boot having a radially inward flange at its upper end, said valve element stem having a recess adjacent said flange, said flange of said boot and said recess of said stem engaging to provide a snug fit.

10. The valve of claim 9 wherein:

said at least one valve stem sidewall opening has an elongate shape, elongate in the direction of said axis of said stem, said sidewall opening being at least partially tapered to provide a transverse distance greater at the upper portion of the opening and lesser at the lower portion of the opening.

11. The valve of claim 2 wherein:

said at least one valve stem sidewall opening has an elongate shape, elongate in the direction of said axis of said stem, said sidewall opening being at least partially tapered to provide a transverse distance greater at the upper portion of the opening and lesser at the lower portion of the opening.

12. The valve of claim 1 wherein: said first portion of said passageway in said button is vertical and said second portion of said passageway in said button is horizontal.

13. The valve of claim 12 wherein: said second portion of said passageway is rectangular in cross-section.

14. The valve of claim 13 further comprising:

a boot portion of said grommet extending upward, said boot having an upper surface at an upper end, a shoulder extending radially outward from said valve stem, said upper surface of said boot engaging said shoulder to provide a force tending to restore said valve to its closed state, said boot having a radially, inward flange at its upper end, said valve element stern having a recess adjacent said flange, said flange of said boot and said recess of said stern engaging to provide a snug fit.

15. The valve of claim 12 further comprising:

a boot portion of said grommet extending upward, said boot having an upper surface at an upper end, a shoulder extending radially outward from said valve stem, said upper surface of said boot engaging said shoulder to provide a force tending to restore said valve to its closed state, said boot having a radially inward flange at its upper end, said valve element stern having a recess adjacent said flange, said flange of said boot and said recess of said stern engaging to provide a snug fit.

16. The valve of claim 12 wherein:

said at least one valve stem sidewall opening has an elongate shape, elongate in the direction of said axis of said stem, said sidewall opening being at least partially tapered to provide a transverse distance greater at the upper portion of the opening and lesser at the lower portion of the opening.

17. The valve of claim 1 further comprising:

a boot portion of said grommet extending upward, said boot having an upper surface at an upper end, a shoulder extending radially outward from said valve stem, said upper surface of said boot engaging said shoulder to provide a force tending to restore said valve to its closed state, said boot having a radially inward flange at its upper end, said valve element stem having a recess adjacent said flange, said flange of said boot and said recess of said stem engaging to provide a snug fit.

18. The valve of claim 17 wherein:

said at least one valve stem sidewall opening has an elongate shape, elongate in the direction of said axis of said stem, said sidewall opening being at least partially tapered to provide a transverse distance greater at the upper portion of the opening and lesser at the lower portion of the opening.

19. The valve of claim 1 wherein:

said at least one valve stem sidewall opening has an elongate shape, elongate in the direction of said axis of said stem, said sidewall opening being at least partially tapered to provide a transverse distance greater at the upper portion of the opening and lesser at the lower portion of the opening.

* * * * *